United States Patent [19]

Leaf

[11] Patent Number: 4,772,047

[45] Date of Patent: Sep. 20, 1988

[54] SKI TIP PROTECTORS

[76] Inventor: Charles E. Leaf, 2110 Sarah Marks Ave., Charlotte, N.C. 28203

[21] Appl. No.: 936,631

[22] Filed: Nov. 28, 1986

[51] Int. Cl.[4] ..... A63C 11/02

[52] U.S. Cl. ..... 280/815; 280/814; 294/147; 211/70.5

[58] Field of Search ..... 280/814, 815, 47.13 R, 280/818; 211/70.5; 294/147; 224/917

[56] References Cited

U.S. PATENT DOCUMENTS

| | | | |
|---|---|---|---|
| 1,045,594 | 11/1912 | Nyberg | 280/815 |
| 3,093,384 | 6/1963 | Daniel | 280/815 |

FOREIGN PATENT DOCUMENTS

| | | | |
|---|---|---|---|
| 847390 | 10/1939 | France | 280/815 |
| 899762 | 6/1945 | France | 280/815 |
| 1552202 | 1/1969 | France | 280/814 |
| 451775 | 5/1968 | Switzerland | 280/814 |
| 581487 | 11/1976 | Switzerland | 280/814 |

OTHER PUBLICATIONS

WO 8001761, published: 9/4/1980, Inventor: Hinderoth, Title: Ski Carrier.

*Primary Examiner*—David M. Mitchell
*Assistant Examiner*—Brian L. Johnson
*Attorney, Agent, or Firm*—Daniel E. McConnell

[57] ABSTRACT

This invention is a pair of devices which are easily applied to and used with snow skis for protecting the tips and heels of the skis against damage otherwise possibly occurring. The devices are in the form of members each having a stem portion and a bifurcated portion. The members are readily placed between opposing running surfaces of skis to be clamped together in a conventional way and are held by clamped engagement with the skis. One device, a Y member, has arcuate portions of which engage the running surfaces of the tips and reinforce the tips against damage otherwise possibly occurring due to mishandling or the like. The other, a T member, has crossbar portions which similarly engage the heel ends of skis and protect them against damage.

9 Claims, 2 Drawing Sheets

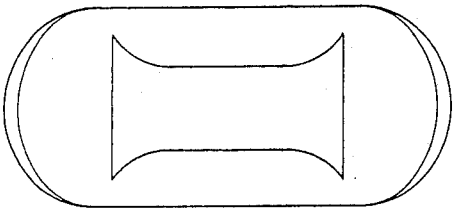
FIG. 4
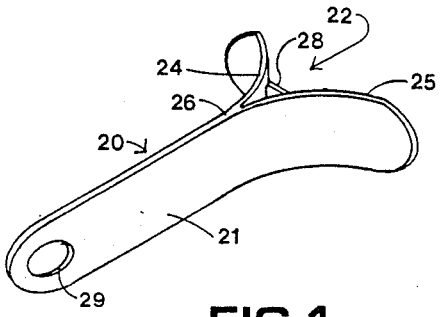
FIG. 1
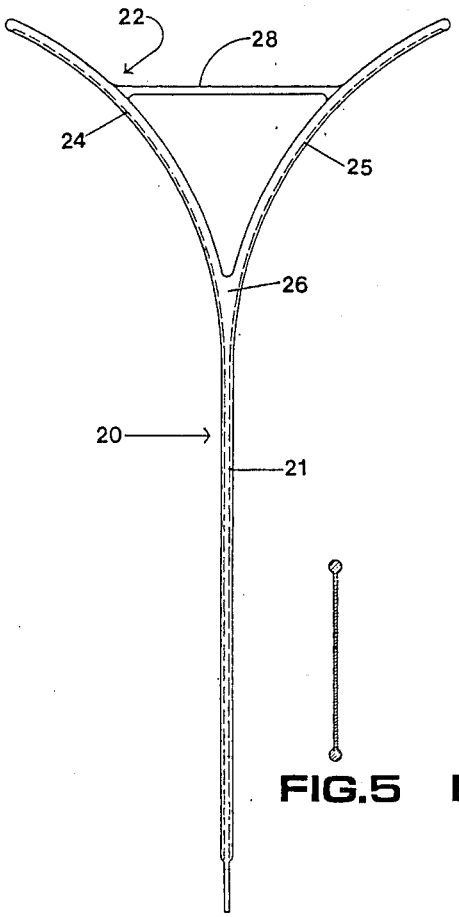
FIG. 2
FIG.5
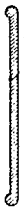
FIG.6
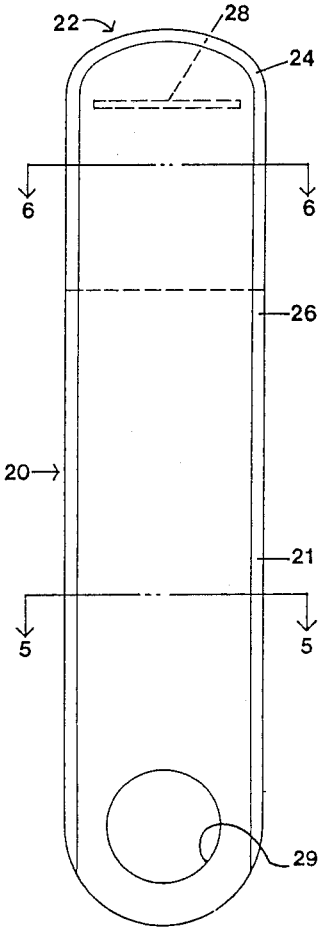
FIG. 3

FIG. 10
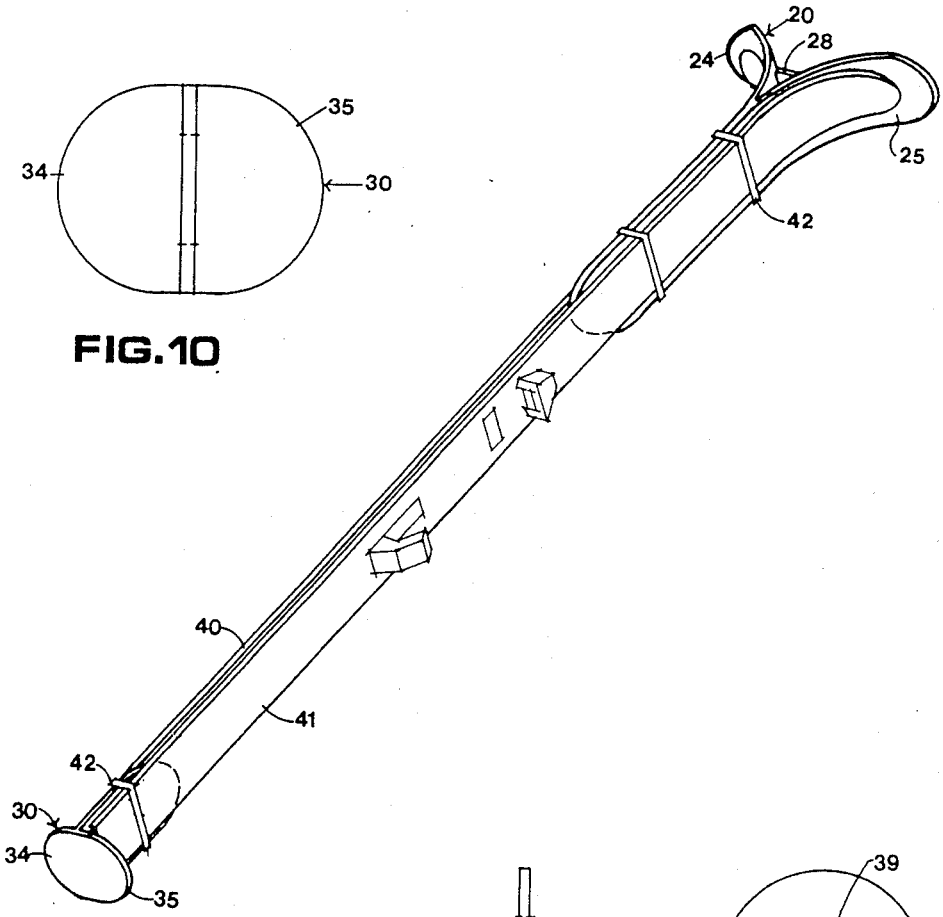
FIG. 11
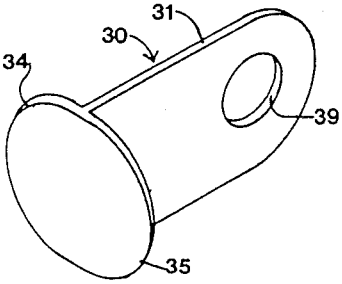
FIG. 7
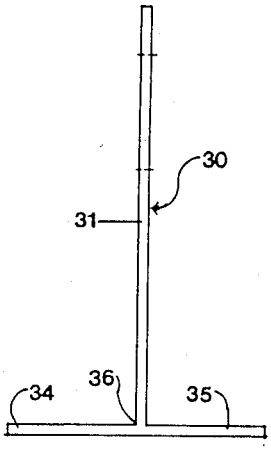
FIG. 8
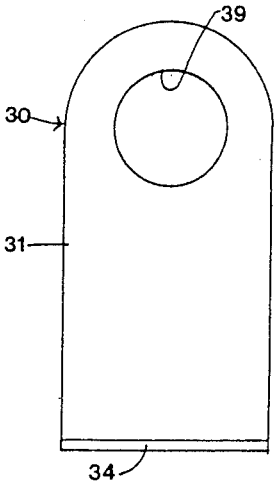
FIG. 9

SKI TIP PROTECTORS

FIELD AND BACKGROUND OF INVENTION

This invention relates to devices for protecting snow skis against damage otherwise possibly occurring and, more particularly, to ski tip protectors.

As will be appreciated by persons who actively pursue the sport of snow skiing, equipment represents a sizable investment and it is desirable to avoid damage to equipment in order to reduce the expense of engaging in the sport. One risk of damage to which skis are exposed in handling is tip or heel breakage or injury while skis are clamped together for transport or storage. Typically, skis are clamped together with the running surfaces of a pair of skis in abutment, and are then handled or stored. It is during such handling or storage that unprotected tips or heels of skis can be damaged.

Storage devices for skis have been proposed heretofore, as in Nyberg U.S. Pat. No. 1,045,594 and others to be found in Class 280, Subclass 815 in the classified patents in the United States Patent and Trademark Office. Such devices are, however, somewhat cumbersome to use and, while possibly useful in long term storage of skis, are not useful on the slopes. Thus the prior devices do not address the protection of skis during intervals of particular heavy use, as where skis are handled at a slope.

BRIEF DESCRIPTION OF INVENTION

With the foregoing in mind, it is an object of this invention to provide devices which are easily applied to and used with skis for protecting the tips and heels of skis against damage otherwise possibly occurring. In realizing this object of the present invention, members having a stem portion and bifurcated portions are provided, the members being readily placed between opposing running surfaces of skis to be clamped together in a conventional way and being held by clamped engagement with the skis. In one device, arcuate portions of the member engage the running surfaces of the tips and reinforce the tips against damage otherwise possibly occurring due to mishandling or the like. In another, crossbar portions engage the running surfaces of the heel and reinforce the heel against such damage.

Yet a further object of this invention is the provision of devices of the character described which are sturdy so as to survive relatively rough handling when not in position with a set of skis. In realizing this object of the present invention, the members are preferably unitarily and integrally formed, desirably by molding a suitable plastic material.

BRIEF DESCRIPTION OF DRAWINGS

Some of the objects of the invention having been stated, other objects will appear as the description proceeds, when taken in connection with the accompanying drawings, in which:

FIG. 1 is a perspective view of a first device, hereinafter referred to as a Y member, for protecting tips of skis;

FIG. 2 is an elevation view of the device of FIG. 1;

FIG. 3 is a side elevation view of the device of FIGS. 1 and 2;

FIG. 4 is a plan view of the device of FIGS. 1 through 3;

FIG. 5 is a section view of the Y member, taken along the line 5—5 in FIG. 2;

FIG. 6 is a section view of the Y member, taken along the line 6—6 in FIG. 2;

FIG. 7 is a perspective view of a second device, hereinafter referred to as a T member, for protecting heels of skis;

FIG. 8 is an elevation view of the device of FIG. 7;

FIG. 9 is a side elevation view of the device of FIGS. 7 and 8;

FIG. 10 is a plan view of the device of FIGS. 7 through 9; and

FIG. 11 is a perspective view of a pair of skis with the Y member of FIGS. 1 through 6 and the T member of FIGS. 7 through 10 in place.

DETAILED DESCRIPTION OF INVENTION

While the present invention will be described more fully hereinafter with reference to the accompanying drawings, in which a preferred embodiment of the present invention is shown, it is to be understood at the outset of the description which follows that persons of skill in the appropriate arts may modify the invention here described while still achieving the favorable results of this invention. Accordingly, the description which follows is to be understood as being a broad, teaching disclosure directed to persons of skill in the appropriate arts, and not as limiting upon the present invention.

Referring now more particularly to the accompanying drawings, devices for protecting skis in accordance with the present invention are there shown and generally designated at 20 for a first or Y member and 30 for a second or T member.

The first device comprises a Y configuration member having an elongate stem portion 21 for contiguous engagement between opposing facing running surfaces of a pair of skis and a bifurcated tip support portion generally indicated at 22 defining first and second arcuate portions (24 and 25, respectively) diverging from a junction (at 26) with the stem portion 21. In use (FIG. 11), the arcuate portions 24, 25 extend in contiguous engagement with opposing facing curved tip running surfaces of a pair of skis. Due to the extended stem portion 21, the member is gripped by a pair of skis 40, 41 clamped together by suitable means such as a clamp device 42 with the running surfaces thereof in facing opposition and with the member 20 interposed therebetween and maintained in position by such gripping engagement while protecting the tips of the skis against damage otherwise possibly occurring.

In order to achieve light weight and reasonable cost of manufacture, it is preferred that the Y member 20 be unitarily and integrally formed by molding a suitable high strength plastic material. Such molding may be by injection molding or other techniques known to the person skilled in plastics manufacturing and the material chosen may be either selected for strength, weight and cost or a reinforced material selected as a compromise for such characteristics. In any event, it is preferred that the stem portion 21 and the arcuate portions 24, 25 have a predetermined width substantially equal to and greater than the width of the running surface of a ski (FIG. 11). The stem portion 21 is preferred to have a length more than twice and less than four times its width, in order to provide a suitable area for engagement by the skis (FIGS. 2 and 3). The arcuate portions 24, 25 are preferred to have lengths which are more than their widths in order to assure that the ski tips are adequately protected. The stem and arcuate portions desirably may have a thickness no greater than about 15 millimeters, in order to maintain a light weight for the device.

In order to provide additional strength and support against damage, the Y member 20 has stiffening means indicated at 28 extending between the arcuate portions 24, 25 and transversely of the longitudinal axis of the stem portion 21 for enhancing rigidity of the member. The stiffening means preferably comprises a generally planar element spaced from the stem portion and oriented with the principal plane thereof substantially perpendicular to the longitudinal axis of the stem portion. The stiffening means is rigid, inextensible and incompressible (FIGS. 1 through 4).

In order to provide for ease in handling and storing the Y member 20 apart from skis, it is preferred that an opening indicated at 29 be formed near the end of the stem portion 21. The opening provides an easy way to handle the device of this invention or to hang it from a nail or peg while the skis with which it is normally used are in use for skiing.

A second device which is preferably used in conjunction with the first device is shown in FIGS. 7 through 10, where a T member generally identified at 30 is shown. The T member is formed, made and used in a manner substantially similar to the Y member described above, and similar reference characters are applied to elements of the T member, with the reference characters being of a 30s order of magnitude. The difference between the Y and T members will be readily apparent, in that the later has crossbar portions 34, 35 which diverge from the juncture 36 to form a straight crossbar for engaging heel end surfaces of the skis 40, 41. The crossbar portions preferably have a length which is less than the width thereof. In other respects, the T member 30 is made and used similarly to the Y member and accordingly the detailed description given above will, in the interests of brevity, not be repeated here.

In the drawings and specifications there has been set forth a preferred embodiment of the invention and, although specific terms are used, the description thus given uses terminology in a generic and descriptive sense only and not for purposes of limitation.

What is claimed is:

1. A device for protecting the tips of snow skis and comprising a Y configuration member having an elongate stem portion for contiguous engagement between opposing facing running surfaces of a pair of skis and a bifurcated tip support portion defining first and second arcuate portions diverging from a junction with said stem portion, said elongate stem portion having a predetermined width greater than the width of the running surfaces and a length which is more than twice and less than four times its width, said arcuate portions extending in contiguous engagement with opposing facing curved tip running surfaces of the pair of skis, and said member having a rigid, inextensible and incompressible stiffening means extending between said arcuate portions and transversely of the longitudinal axis of said stem portion for enhancing rigidity of said member, whereby said member is gripped by a pair of skis clamped together with the running surfaces thereof in facing opposition and with said member interposed therebetween and maintained in position by such gripping engagement while protecting the tips of the skis against damage otherwise possibly occurring.

2. A device according to claim 1 wherein said stem portion and said bifurcated portion have a thickness of no more than about 15 millimeters.

3. A device according to claim 2 wherein said stiffening means comprises a generally planar element spaced from said stem portion and oriented with the principal plane thereof substantially perpendicular to the longitudinal axis of said stem portion.

4. A device according to any one of claims 1 through 3 wherein said stem portion and said bifurcated portion are unitarily and integrally formed.

5. A device according to any one of claims 1 through 3 wherein said member is molded plastic.

6. A device for protecting skis and comprising a unitarily and integrally formed Y configuration member having an elongate stem portion for contiguous engagement between opposing facing running surfaces of a pair of skis, said stem portion having a predetermined width greater than the width of the running surface of a ski and a length which is more than twice and less than four times its width, and said member having a bifurcated tip support portion defining first and second arcuate portions diverging from a junction with said stem portion, said arcuate portions each having a predetermined width greater than the width of the running surface of a ski and a length which is more than its width, and said arcuate portions extending in contiguous engagement with opposing facing curved tip running surfaces of the pair of skis, whereby said member is gripped by a pair of skis clamped together with the running surfaces thereof in facing opposition and with said member interposed therebetween and maintained in position by such gripping engagement while protecting the tips of the skis against damage otherwise possibly occurring.

7. A device according to claim 6 wherein said stem portion and said arcuate portions have a thickness of no more than about 15 millimeters and further comprising stiffening means extending between said arcuate portions and transversely of the longitudinal axis of said stem portion for enhancing rigidity of said member.

8. A device according to claim 7 wherein said stiffening means comprises a generally planar element spaced from said stem portion and oriented with the principal plane thereof substantially perpendicular to the longitudinal axis of said stem portion.

9. A package of snow skis protected against damage otherwise possibly occurring and comprising:

a pair of snow skis arranged with the running surfaces thereof in opposing facing relationship, the skis have heel ends and tip ends and being oriented with the heel and tips ends thereof together, a unitarily and integrally formed T configuration heel protection member having an elongate stem portion for contiguous engagement between said opposing facing running surfaces of said skis, said stem portion having a predetermined width greater than the width of said running surfaces and a length which is at least twice its width, and said T member having a bifurcated heel end support portion defining first and second crossbar portions diverging from a junction with said stem portion, said crossbar portions each having a predetermined width greater than the width of said running surfaces and a length which is less than its width, and said crossbar portions extending in contiguous engagement with adjacent heel end surfaces of said skis, a unitarily and integrally formed Y configuration member having an elongate stem portion for contiguous engagement between said opposing facing running surfaces of said skis, said stem portion having a predetermined width greater than the width of said running surfaces and a length which is more than twice and less than four times its width, and said Y member having a bifurcated tip support portion defining first and second arcuate portions diverging from a junction with said stem portion, said arcuate portions each having a predetermined width greater than the width of said running surfaces of and a length which is more than its width, and said arcuate portions extending in contiguous engagement with opposing facing curved tip running surfaces of said skis, and means for clamping said skis together and thereby for gripping said T member and said Y member therebetween.

* * * * *